United States Patent [19]

Shihyakugari et al.

[11] Patent Number: 4,578,972

[45] Date of Patent: Apr. 1, 1986

[54] APPARATUS FOR DRAWING WIRE

[75] Inventors: Shigeo Shihyakugari, Funabashi; Osamu Kohno, Chiba; Yoshimitsu Ikeno, Tokyo, all of Japan

[73] Assignee: Fujikura Ltd., Tokyo, Japan

[21] Appl. No.: 618,120

[22] Filed: Jun. 7, 1984

[30] Foreign Application Priority Data

| | | | |
|---|---|---|---|
| Jun. 10, 1983 | [JP] | Japan | 58-103821 |
| Jun. 10, 1983 | [JP] | Japan | 58-103822 |
| Jun. 14, 1983 | [JP] | Japan | 58-106077 |

[51] Int. Cl.[4] ..... B21C 1/34

[52] U.S. Cl. ..... 72/24; 72/285

[58] Field of Search ..... 72/285, 291, 287, 290, 72/24

[56] References Cited

U.S. PATENT DOCUMENTS

| | | | |
|---|---|---|---|
| 2,264,688 | 12/1941 | Wolf | 72/291 |
| 2,767,829 | 10/1956 | Hallden | 72/285 |
| 3,116,832 | 1/1964 | Pieron et al. | 72/24 |
| 3,238,752 | 3/1966 | Dilling | 72/285 |
| 3,668,910 | 6/1972 | Gentry et al. | 72/24 |

FOREIGN PATENT DOCUMENTS

| | | | |
|---|---|---|---|
| 1069923 | 7/1954 | France | 72/290 |
| 435026 | 7/1974 | U.S.S.R. | 72/291 |

*Primary Examiner*—Daniel C. Crane

*Attorney, Agent, or Firm*—Armstrong, Nikaido, Marmelstein & Kubovcik

[57] ABSTRACT

A wire drawing apparatus includes a carriage movable along an elongated frame. A chuck is mounted on the frame for holding one end of a wire, and a drawing die is mounted on the carriage for passing the wire therethrough. An actuating device is connected to the carriage for moving it along the frame to move the die along the wire so as to reduce the cross-section of the wire. A plurality of clamp devices are mounted on the frame and spaced along the length thereof for holding the wire. A plurality of drive devices are operatively connected respectively to the clamp devices to move them into and out of an operative position in a path of travel of the carriage where the clamp devices engage the wire. A plurality of position sensors are operatively connected respectively to the drive devices and sense the approaching of the carriage toward the respective clamp devices disposed adjacent thereto to produce a sensing signal in response to which each drive devices is operated to move the clamp device associated therewith out of its operative position.

5 Claims, 10 Drawing Figures

APPARATUS FOR DRAWING WIRE

BACKGROUND OF THE INVENTION

1. Field of the Invention

This invention relates to an apparatus for drawing a wire to reduce a cross-section thereof.

2. Prior Art

One conventional wire drawing apparatus 10 shown in FIG. 1 comprises a horizontal elongated frame 11 having front and rear ends 11*a* and 11*b*, such wire drawing apparatus being commonly referred to as "drawbench" in the trade. A drawing die 12 is detachably mounted on the top 11*c* of the frame 11 and disposed intermediate opposite ends thereof. A carriage 13 is mounted on the top 11*c* of the frame 11 for reciprocable movement along a drawing section 11*d* of the frame 11 extending between the drawing die 12 and the front end 11*a*.

A chuck 14 is fixedly secured to one end of the carriage 13 directed toward the drawing die 12. A hook member 15 is mounted on the other end of the carriage 13 for vertical pivotal movement. A drive sprocket 16 is rotatably mounted on the front end 11*a* of the frame 11 while a driven sprocket 17 is rotatably mounted on the frame 11 at a position below the drawing die 12. A plurality of guide rollers 18 are roratably mounted on the frame 11 and disposed between the drive and driven sprockets 16 and 17. An endless chain 20 extends around the drive and driven sprockets 16 and 17 and is held under an appropriate tension by the guide rollers 18. The drive sprocket 17 is operatively connected to a motor (not shown) for being driven for rotation. The endless chain 20 is composed of two pairs of parallel, longitudinally disposed links 20*a* and transverse pins 20*b* interconnecting the links 20*a*, as shown in FIG. 2. The hook member 15 is adapted to be engaged with a selected one of the pins 20*b* of the endless chain 20.

For drawing a wire 22, one end of the wire 22 is first processed into a tapered shape, and the wire 22 is placed on the top 11*c* of a delivery section 11*e* of the frame 11 with the tapered end passed through the hole of the drawing die 12. Then, the tapered end passing through the hole of the drawing die 12 is clamped by the chuck 14. Then, the hook member 15 is pivotally moved downwardly to engage the pin 20*b* of the endless chain 20 disposed below the hook member 15, as shown in FIG. 3. The endless chain 20 is driven by the motor to move around the drive and driven sprockets 16 and 17 to move the carriage 13 along the frame 11 toward the front end 11*a* thereof, so that the wire 22 is pulled through the drawing die 12 to reduce the diameter thereof at a predetermined rate. Then, the wire 22 is detached from the chuck 14. Then, the drawing die 12 is replaced by another die having a hole smaller in diameter than the hole of the die 12. Then, one end of the wire 22 is again processed to reduce its diameter so that the reduced or tapered end can be passed through the drawing die. The second drawing operation is carried out according to the above-mentioned procedure. Usually, the wire is drawn several times in this manner, using drawing dies having holes of different diameters. Thus, the wire is reduced in diameter or cross-section at a predetermined rate each time the drawing operation is carried out. When a wire having a diameter of 20 mm is to be reduced to a diameter of 4 mm at a reduction rate of 20%, the drawing operation must be carried out seven times, and each time the drawing operation is completed, the wire has to be transferred from the drawing section 11*d* to the delivery section 11*e* for the next drawing operation. This requires much time and is not efficient. In addition, the wire is liable to be damaged or bent during the transferring thereof. Further, with this conventional drawing apparatus, it is necessary that the delivery section 11*e* should have a length generally equal to that of the drawing section 11*d*. Thus, the frame 11 has to be twice the length of the finished wire. As a result, the wire drawing apparatus 10 has a substantially increased overall length and therefore is space-consuming.

SUMMARY OF THE INVENTION

It is therefore an object of this invention to provide a wire drawing apparatus which is substantially reduced in length, and does not require a wire to be transferred from the discharge side to the delivery side for a subsequent drawing operation each time the drawing operation is completed, thereby preventing the wire from being damaged or bent during the drawing operation.

According to the present invention, there is provided an apparatus for drawing a wire which comprises an elongated frame; a carriage mounted on the frame for movement therealong; a chuck mounted on the frame at one end thereof for holding one end of the wire; a drawing die mounted on the carriage for passing the wire therethrough; actuating means operatively connected to the carriage for moving it along the frame away from the chuck to move the die along the wire so as to reduce a cross-section of the wire; a plurality of clamp devices mounted on the frame and spaced along the length thereof for holding the wire; a plurality of drive devices mounted adjacent to the clamp devices, respectively, each of the drive devices being operatively connected to a respective one of the clamp devices for moving it into and out of an operative position sensors mounted adjacent to the clamp devices, respectively, each of the position sensors being operatively connected to a respective one of the drive devices and sensing the approaching of the carriage toward a respective one of the clamp devices disposed adjacent thereto to produce a sensing signal in response to which the drive device is operated to move the clamp device out of its operative position.

DESCRIPTION OF THE PREFERRED EMBODIMENT OF THE INVENTION

In the specification, the term "wire" means both a wire of the solid type and a hollow elongated element.

Figure 1:
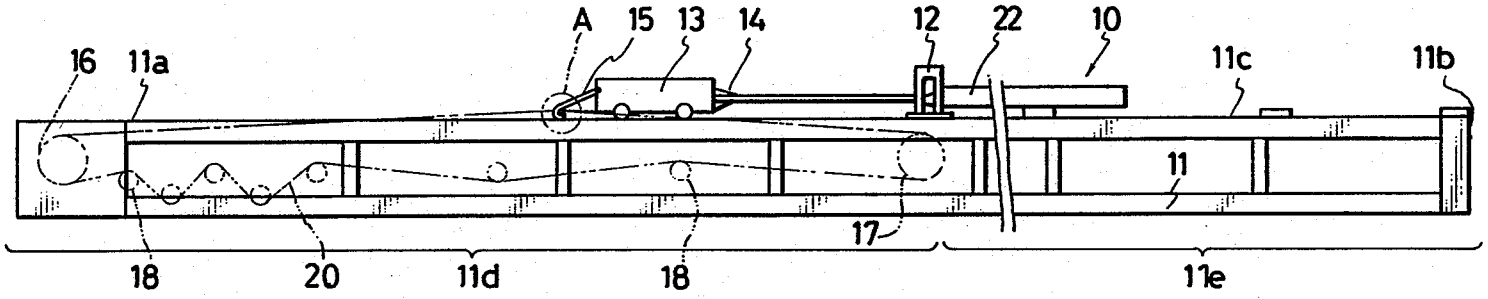
FIG.1 (Prior Art)
FIG. 1 is a schematic side-elevational view of a wire drawing apparatus provided in accordance with the prior art.
Figure 3:
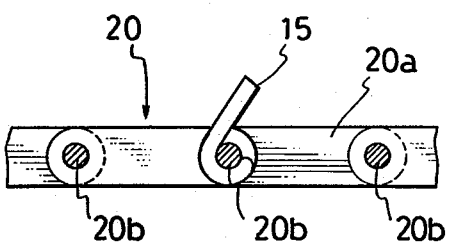
FIG.3 (Prior Art)
FIG. 3 is a cross-sectional view taken along the line III—III of FIG. 2.
Figure 2:
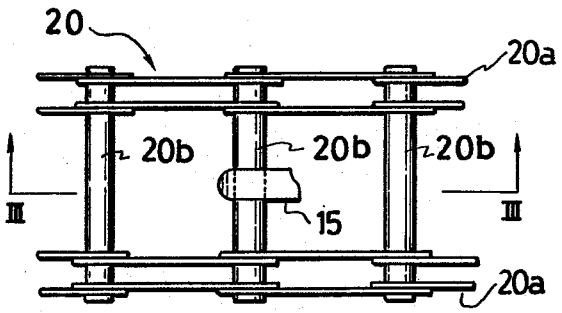
FIG.2 (Prior Art)
FIG. 2 is a plan view of the portion of the wire drawing apparatus indicated by a circle A of FIG. 1.
Figure 4:
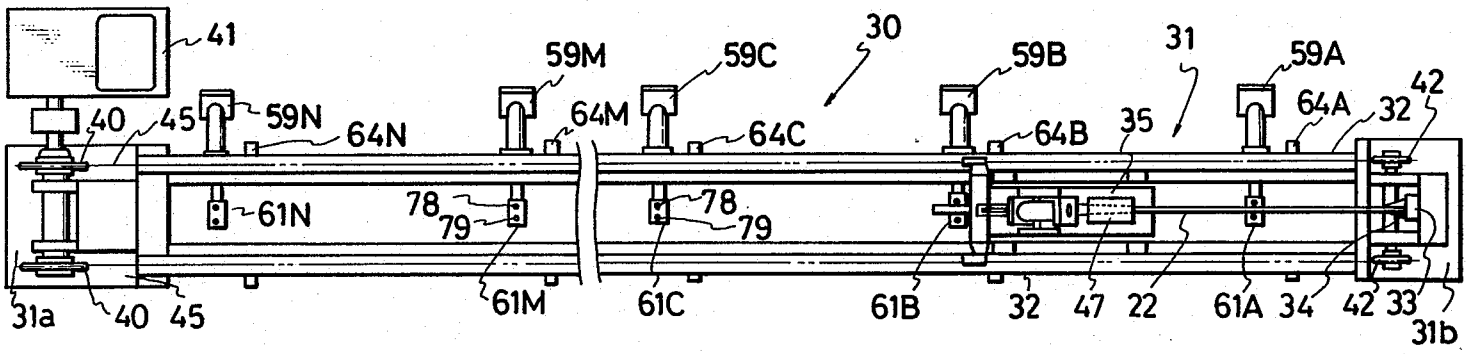
FIG. 4 is a plan view of a wire drawing apparatus provided in accordance with the present invention.
Figure 5:
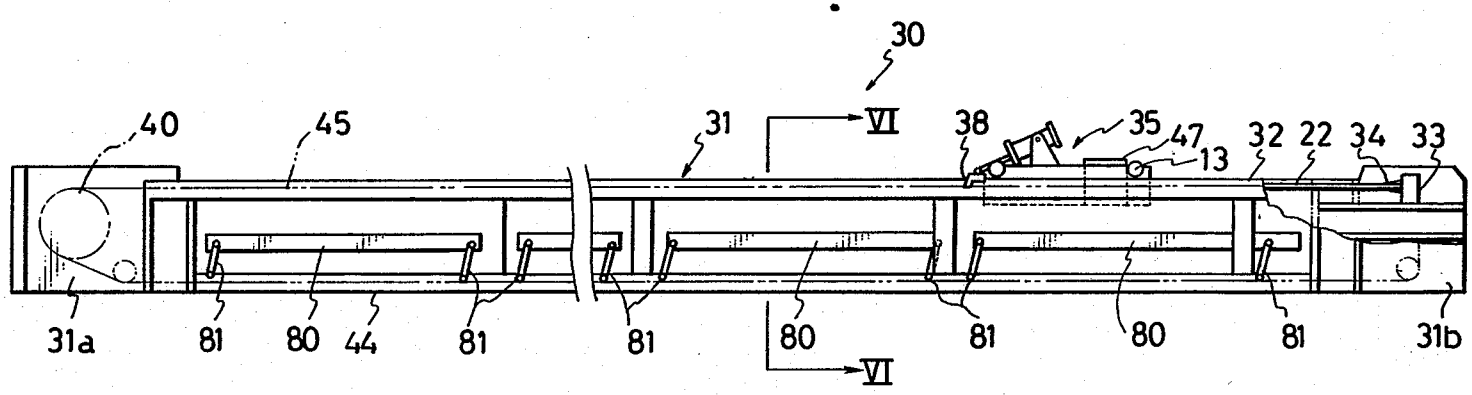
FIG. 5 is a side-elevational view of the drawing apparatus of FIG. 4.

A wire drawing apparatus 30 shown in FIGS. 4 and 5 comprises a horizontal elongated frame 31 which includes front and rear end members 31*a* and 31*b* and a pair of parallel spaced upper rails 32 and 32 extending horizontally between the front and rear end members 31*a* and 31*b*. An upright support member 33 is fixedly mounted on the rear end member 31*b*. A chuck 34 is fixedly mounted on one surface of the support member 33 directed toward the front end member 31*a*, the chuck 34 being adapted to hold one end of a wire 22.

Figure 6:
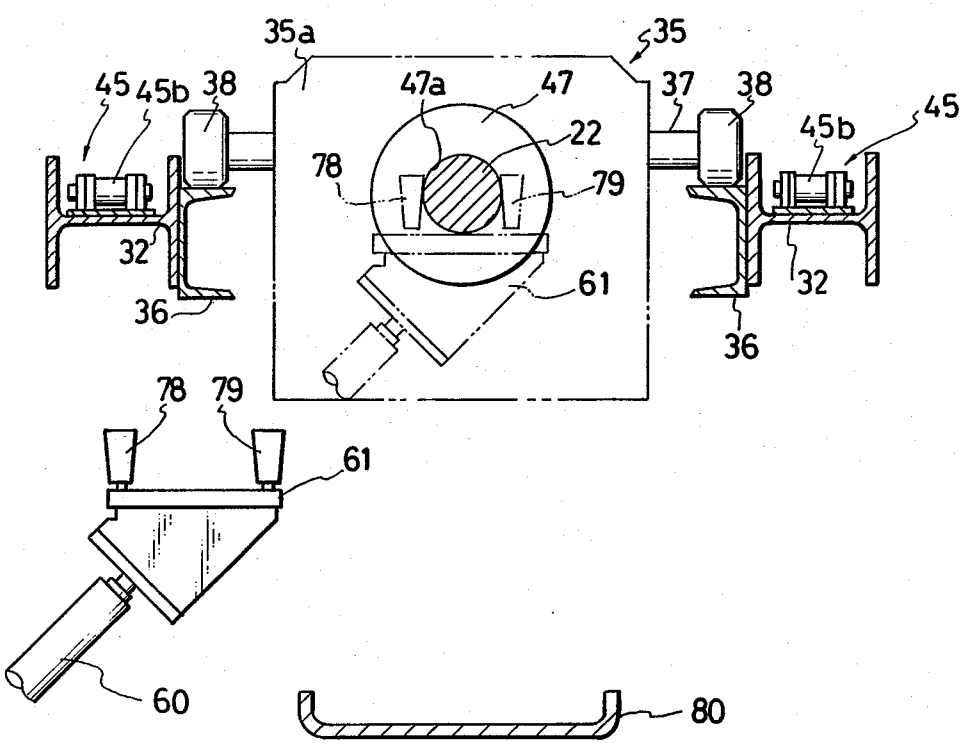
FIG. 6 is a schematic cross-sectional view of the drawing apparatus taken along the line VI—VI of FIG. 5.

A carriage 35 is mounted on the frame 31 for reciprocable movement therealong between the chuck 34 and the front end member 31*a*. As best shown in FIG. 6, each of the upper rails 32 and 32 has an H-shaped cross-section. A pair of guide rails 36 and 36 of a channel-shaped cross-section are fixedly secured to the opposed sides of the H-shaped rails 32 and 32. The carriage 35 includes a body 35*a*, and front and rear axles 37 each mounted on the body 35*a* and supporting wheels 38 at opposite ends thereof, the wheels 38 being disposed in rolling engagement with the guide rails 36 and 36.

A pair of drive sprockets 40 and 40 are rotatably mounted on the front end member 31*a* and are operatively connected to an electric motor 41 for being driven for rotation. Also, a pair of driven sprockets 42 and 42 are rotatably mounted on the rear end member 31*b*. The frame 31 also includes a pair of parallel spaced lower rails 44 extending horizontally between the front and rear end members 31*a* and 31*b*. A pair of endless chains 45 and 45 each extends around the drive and driven sprockets 40 and 42 and is guided by the upper and lower rails 32 and 44. Each of the endless chains 45 and 45 is composed of longitudinally disposed links 45*a* and transverse pins 45*b* as best shown in FIG. 7.

Figure 7:
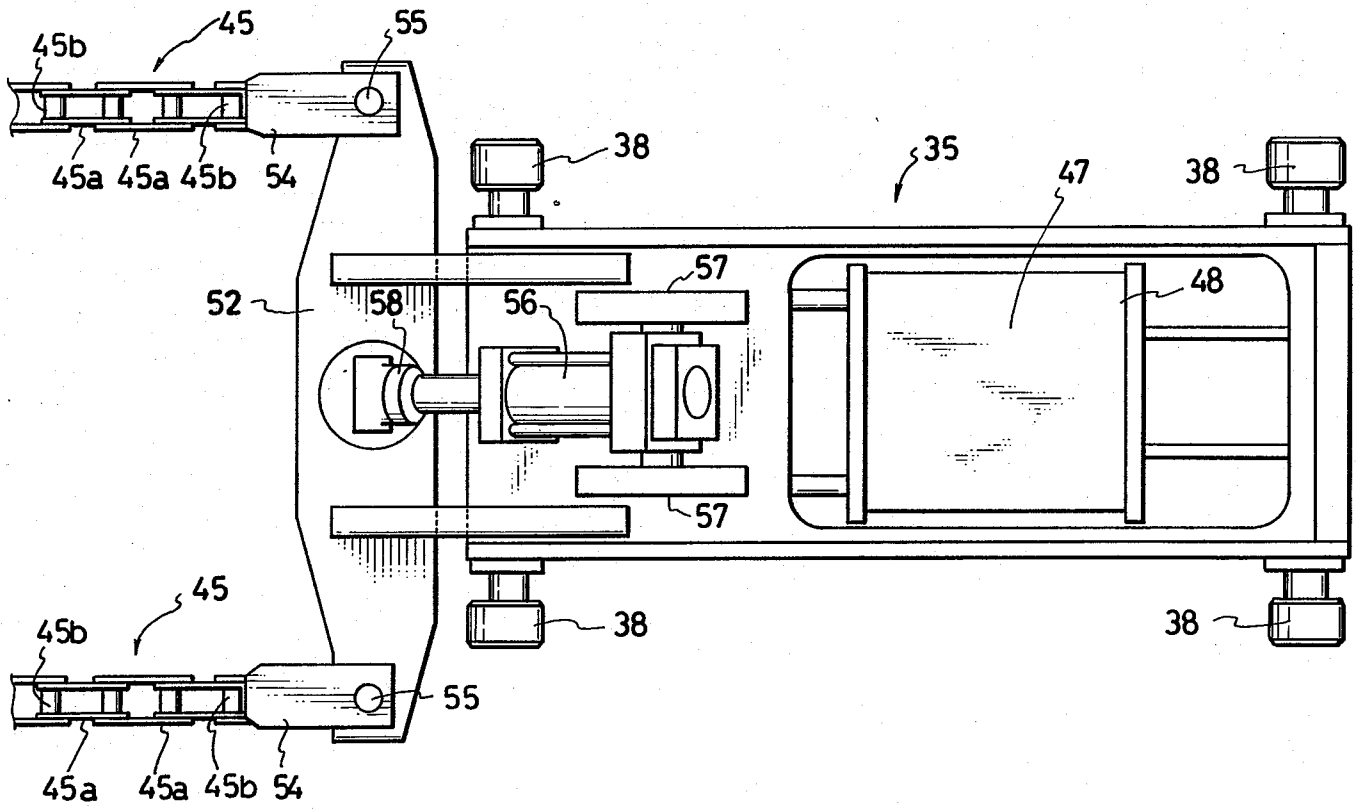
FIG. 7 is a plan view of a carriage.
Figure 8:
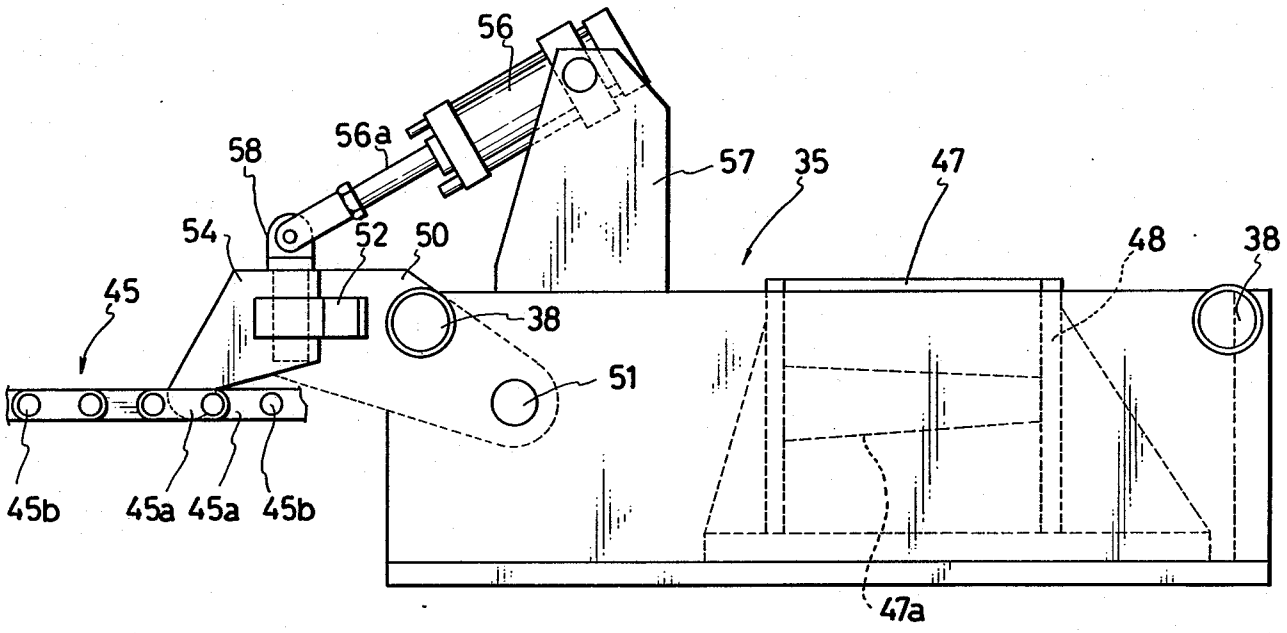
FIG. 8 is a side-elevational view of the carriage.

As best shown in FIGS. 7 and 8, a drawing die 47 is detachably mounted on the carriage 35 through a die holder 48, and has a die hole 47*a* for passing the wire 22 therethrough to draw it. The die hole 47*a* is tapered in a direction toward the chuck 34 and has an axis disposed in alignment with the axis of the chuck 34 and disposed in parallel with the longitudinal axis of the frame 31. Also, the axis of the die hole 47*a* passes perpendicularly through the axes of the transverse pins 45*b* of that portion of each endless chain 45 riding on the upper rail 32.

A pair of parallel spaced links 50 and 50 are mounted at one end thereof on one end of the carriage 35 by pins 51 for pivotal movement thereabout. An arm 52 is fixedly secured to the other ends of the links 50 and 50, the arm 52 being disposed transversely of the pair of endless chains 45 and 45. A pair of hook members 54 and 54 are pivotally mounted on the opposite ends of the arm 52 by pins 55 and 55 for pivotal movement thereabout. A pneumatic cylinder 56 is mounted on the carriage 35 through a pair of brackets 57 and 57. A piston rod 56*a* of the pneumatic cylinder 56 is pivotally connected to the arm 52 through a connecting member 58. With this construction, the pneumatic cylinder 56 is actuated to extend the piston rod 56 to angularly move the arms 52 counterclockwise (FIG. 8) about the pins 51 and 51 so that each of the hook members 54 and 54 is caused to engage one of the transverse pins 45*b* of the endless chain 45.

A plurality of elevating or drive devices 59A to 59N in the form of a pneumatic cylinder are mounted on one of the lower rails 44 of the frame 31 and are spaced along the length of the frame 31. The pneumatic cylinders 59A to 59N are disposed substantially perpendicular to the path of travel of the drawing die 47 carried by the carriage 35. Clamp devices 61A to 61N are mounted on distal ends of piston rods 60A to 60N of the pneumatic cylinders 59A to 59N, respectively, through mounting members 62. Each of the clamp devices 61A to 61N is moved between a lower or inoperative position indicated in a solid line in FIG. 6 and an upper or operative position indicated in phantom in FIG. 6 by a respective one of the pneumatic cylinders 59A to 59N. Each clamp device, when in its upper position, is disposed in the path of travel of the carriage 35 for holding the wire 22, as hereinafter more fully described.

A plurality of position sensors 64A to 64N are mounted on one of the upper rails 32 and 32 and are disposed adjacent to the pneumatic cylinders 59A to 59N, respectively, each position sensor being in the form of photosensor. Each position sensor serves to detect the approaching of the carriage 35 toward a respective one of the clamp devices 61A to 61N disposed adjacent to it, so that the clamp device is retracted from the path of travel of the carriage 35 by the associated one of the pneumatic cylinders 59A to 59N to prevent the associated clamp device from interfering with the carriage 35 moving along the upper rails 32 and 32. And, after the carriage 35 moves past the thus retracted clamp device, this clamp device is moved to its upper position by the associated one of the pneumatic cylinders 59A to 59N when the position sensor disposed next to, that is, forwardly of the retracted clamp device senses the approaching of the carriage 35. More specifically, each of the pneumatic cylinders 59A to 59N is actuated to retract its piston rod 60A to 60N through a control means (not shown) in response to a sensing signal from the associated one of the position sensors 64A to 64N disposed adjacent to and rearwardly of it, thereby bringing the associated clamp device into its lower position. And, each of the pneumatic cylinders 59A to 59N in actuated to extend its piston rod 60A to 60N through the control means in response to a sensing signal from the one of the position sensors 64A to 64N disposed next to, i.e., forwardly of it, thereby bringing the retracted clamp device into its upper position.

Figure 9:
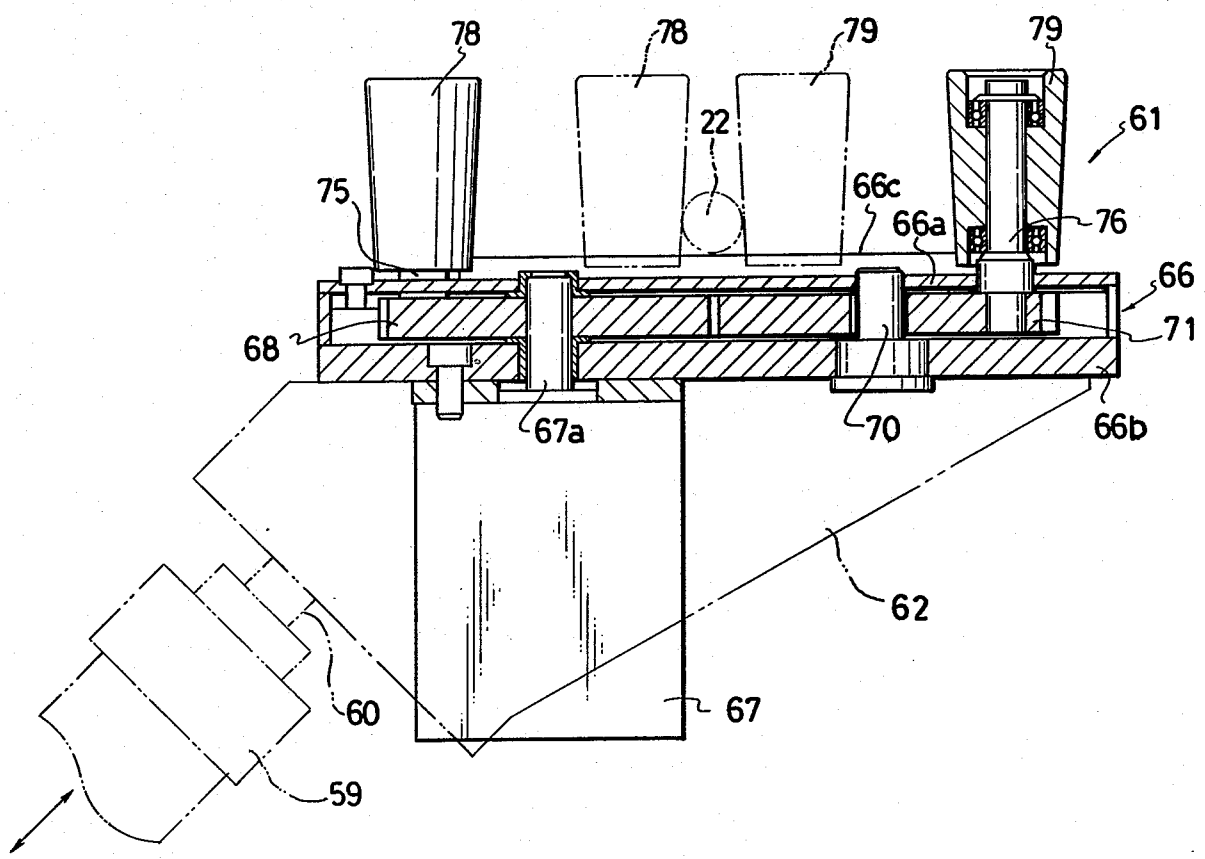
FIG. 9 is a cross-sectional view of a clamp device.
Figure 10:
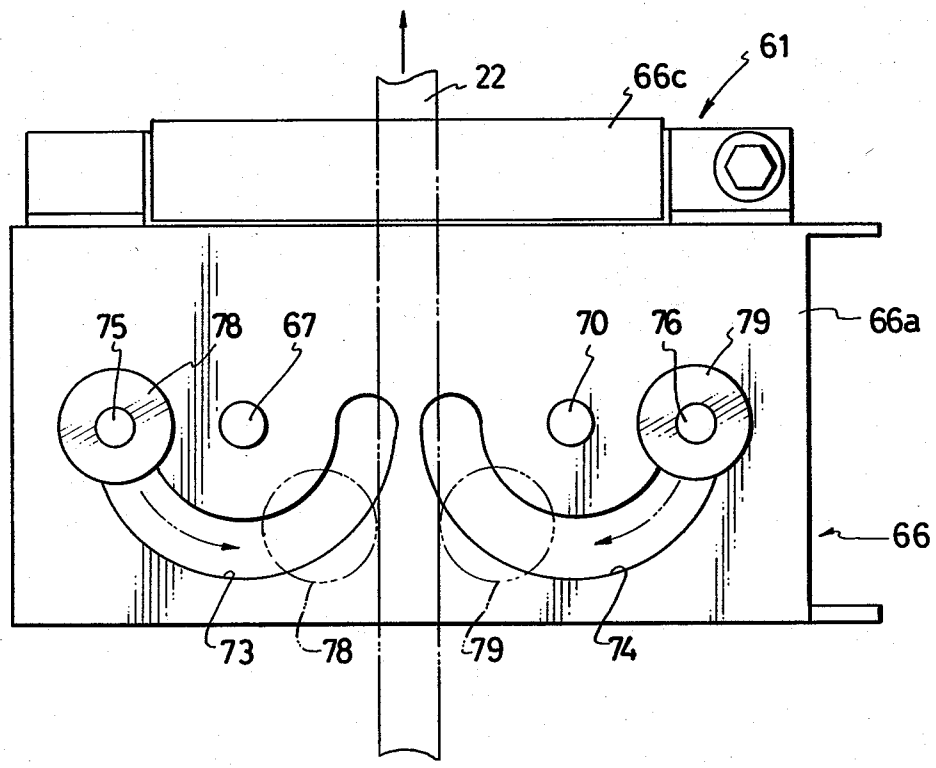
FIG. 10 is a plan view of the clamp device.

As shown in FIGS. 9 and 10, each clamp device 61 (61A to 61N) includes a hollow body 66 of a rectangular shape connected to the piston rod 60 (60A to 60N) of the pneumatic cylinder 59 (59A to 59N) through the mounting member 62, the body comprising a pair of horizontally-disposed upper and lower plates 66*a* and 66*b* and a horizontally-disposed support member 66*c* for supporting the wire 22. A pneumatically-operated rotary actuator 67 is mounted on the lower plate 66*b* of the body 66 and has an output shaft 67*a* extending through the lower and upper plates 66*b* and 66*a*. A first gear 68 is received in the hollow body 66 and fixedly mounted on the output shaft 67*a* of the rotary actuator 67 in coaxial relation thereto. A shaft 70 extends through and is fixed to the lower and upper plates 66*b* and 66*a* of the body 66. A second gear 71 is received in the hollow body 66 and rotatably mounted on the shaft 70 in coaxial relation thereto. The first and second gears 68 and 71 are in mesh with each other and are disposed horizontally. A pair of arcuate slots 73 and 74 are formed through the upper plate 66*a* and disposed symmetrically with respect to the axis of the hole 47*a* of the drawing die 47 when the clamp device 61 is in its upper position. A vertical pin 75 is fixedly mounted on the first gear 68 in eccentric relation to the output shaft 67*a* and is received in the arcuate slot 73 for movement therealong. Also, another vertical pin 76 is fixedly mounted on the second gear 71 in eccentric relation to the shaft 70 and is received in the arcuate slot 74 for movement therealong. A roll 78 is rotatably mounted on the pin 75 in coaxial relation thereto while another roll 79 is rotatably mounted on the pin 76 in coaxial relation thereto, each of the rolls 78 and 79 tapering downwardly toward the upper plate 66*a*.

The rotary actuator 67 is actuated to angularly move the output shaft 67*a* about its axis so that the rolls 78 and 79 are moved along the respective arcuate slots 73 and 74 toward and away from each other. The rotary actuator 67 is actuated to move the rolls 78 and 79 toward each other to hold the wire 22 therebetween when the clamp device 61 is moved to its upper position. Also, the rotary actuator 67 is actuated to move the rolls 78 and 79 out of engagement with the wire 22 immediately before the clamp device 61 is moved to its lower position. This operation of the rotary actuator 67 is controlled through the control means in response to the sensing signals from the position sensors 64, as hereinafter more fully described.

A plurality of horizontal elongated receptacles 80 are mounted on the lower rails 44 and 44 and spaced along the length of the frame 31 for receiving the wire 22 if it is cut during the drawing operation. Each receptacle 80 is mounted on the lower rails 44 and 44 through a pair of pivotal links 81 and 81 for being vertically adjusted.

For drawing the wire 22, one end of the wire 22 is first processed into a tapered shape. The carriage 35 is located immediately adjacent to the chuck 34. The clamp device 61A is held in its lower position so that it will not interfere with the carriage 35. The taper end of the wire 22 is passed through the hole 47*a* of the drawing die 47 and is clamped by the chuck 34. The clamp devices 61B to 61N are moved to their upper positions. Then, the pneumatic cylinder 56 is operated to angularly move the arm 52 in a counterclockwise direction (FIG. 8) so that the pair of hook members 54 and 54 are caused to engage the transverse pins 54*b* of the respective endless chains 45 and 45. Then, the endless chains 45 and 45 are driven by the motor 41 through the drive sprocket 40 to move the carriage 35 along the upper rails 32 and 32 toward the front end member 31*a*, so that the drawing die 47 moves along the wire 22 to reduce the diameter thereof at a predetermined rate.

During this drawing operation, each clamp device 61 is moved to its lower position by the associated pneumatic cylinder 59 when the carriage 35 approaches it, and is returned to its upper position by the pneumatic cylinder 59 after the carriage 35 moves past it. More specifically, soon after the carriage 35 starts moving along the upper rails 32 and 32 toward the front end member 31*a*, the position sensor 64B detects the approaching of the carriage 35 toward the clamp device 59B, so that the rotary actuator 67 of the clamp device 59B is actuated to bring the pair of rolls 78 and 79 out of engagement with the wire 22. Subsequently, the clamp device 59B is moved to its lower position by the pneumatic cylinder 59B so as not to interfere with the moving carriage 35. Then, the carriage 35 continues to move along the upper rails 32 and 32, and the next position sensor 64C detects the approaching of the carriage 35 toward the clamp device 61C, so that the pneumatic cylinder 59B is actuated to extend its piston rod 60B to bring the clamp device 61B to its upper position, and that the rotary actuator 67 of the clamp device 61B is actuated to bring the rolls 78 and 79 into engagement with the wire 22 to hold it therebetween. Also, when the position sensor 64C detects the approaching of the carriage 35, the rotary actuator 67 of the clamp device 61C is actuated to bring the rolls 78 and 79 out of engagement with the wire 22, and then the pneumatic cylinder 59C is actuated to move the clamp device 61C to its lower position. Then, the position sensors 64D to 64N sequentially detect the approaching of the carriage 35 to operate the clamp devices 61D to 61N and their associated rotary actuators 67 in the manner described above.

After the drawing die 47 moves past the free end of the wire 22 remote from the chuck 34, the pneumatic cylinder 56 is actuated to retract its piston rod 56*a* so that the hook members 54 and 54 are angularly moved about the pins 51 and 51 and disengaged from the respective transverse pins 45*b* and 45*b* of the endless chains 45 and 45. Then, the carriage 35 is moved back along the rails 32 and 32 toward the rear end member 31*b*, and the drawing die 47 is detached from the die holder 48 and replaced by another die having a die hole smaller in diameter than the hole 47*a* of the drawing die 47. Then, a second drawing operation is carried out according to the procedure mentioned above. The wire 22 is drawn several times in this manner, using a plurality of drawing dies having die holes of different diameters until the wire 22 is reduced to a desired diameter.

Since the wire 22 is supported by the clamp devices 61 during the drawing operation, the wire 22 is not subjected to bending and vibration. Therefore, the drawn wire 22 does not have marks on its surface which are caused by the drawing die 47 if the wire 22 is not held in alignment with the hole 47*a* of the die 47.

As described above, the axes of the transverse pins 45*b* of those portions of the endless chains 45, 45 pass perpendicularly through the axis of the hole 47*a* of the drawing die 47 and the axis of the chuck 34. With this arrangement, the pulling force, applied to the drawing die 47 by the endless chains 45 and 45 through the hook members 54 and 54, is exerted on the common axis of the chuck 34 and die hole 47*a*. Therefore, the die 47 will not cause marks on the surface of the drawn wire.

The upper surface of each upper rail 32 may not always be completely smooth and may be slightly rugged at some locations, in which case the die 47 is slightly moved vertically when the carriage 35 passes such rugged portions of the rails 32 and 32. The downwardly-tapering rolls 78 and 79 permit the wire 22 to follow this slight vertical movement of the drawing die 47 since the rotary actuator 67 is pneumatically operated.

If the wire 22 is accidentally cut during the drawing operation, the wire is no longer subjected to tension applied by the endless chains 45 and 45. Even in this case, the downwardly-tapering rolls 78 and 79 continue to hold the wire against the support member 66*c* of the clamp device 61. Thus, the cut wire is prevented from leaping upwardly.

The wire drawing apparatus 30 does not require a delivery section as is the case with the prior art wire drawing apparatus 10 and therefore can be reduced to a length generally equal to the length of the finished wire.

Thus, the wire drawing apparatus 30 is quite space-saving. In addition, the wire does not need to be transferred to the delivery section each time the drawing operation is completed. Therefore, the drawing operation can be carried out quite efficiently. Further, since it is not necessary to transfer the wire during the successive drawing operations, the wire can be prevented from being damaged bent.

What is claimed is:

1. Apparatus for drawing a wire which comprises:

(a) an elongated frame;

(b) a carriage mounted on said frame for movement therealong;

(c) a chuck fixedly mounted to said frame at one end thereof for holding one end of the wire;

(d) a drawing die mounted on said carriage for passing the wire therethrough;

(e) actuating means operatively connected to said carriage for moving it along said frame away from said chuck to move said die along the wire so as to reduce the cross-section of the wire;

(f) a plurality of clamp devices fixedly mounted relative to said frame and spaced along the length thereof for holding the wire, each said clamp device having a pair of clamping members movable toward each other for holding the wire therebetween;

(g) a plurality of drive devices mounted adjacent to said clamp devices, respectively, each of said drive devices being operatively connected to a respective one of said clamp devices for moving it into and out of an operative position in a path of travel of said carriage where said clamp device engages the wire to hold it; and (h) a plurality of position sensors mounted adjacent to said clamp devices, respectively, each of said position sensors being operatively connected to a respective one of said drive devices and sensing the approaching of said carriage toward a respective one of said clamp devices disposed adjacent thereto to produce a sensing signal in response to which said drive device is operated to move said clamp device out of its operative position.

2. Apparatus according to claim 1, in which said carriage has a pair of parallel spaced vertically-pivotable hook members mounted on one end thereof facing away from the one end of said frame, said drive means including a pair of parallel spaced endless chains movable along said frame, each of said endless chains having a plurality of pins disposed transversely of the axis of said frame, said hook members being operable to engage respective ones of said transverse pins of said endless chains so that said carriage is driven for movement along said frame, said drawing die having a die hole for passing the wire therethrough, the axis of said die hole being in alignment with the axis of said chuck and disposed in parallel with the longitudinal axis of said frame, and said axis of said die hole also passing perpendicularly through the axes of said transverse pins of said endless chains.

3. Apparatus according to claim 1, in which each of said clamp devices comprises a body having a surface engageable with the wire, and a pair of parallel spaced rolls mounted on said surface for rotation about their axes and disposed on opposite sides of the path of travel of said drawing die, said rolls tapering toward said surface of said body, said rolls being operable to be moved toward each other to hold the wire therebetween when said clamp device is in its operative position.

4. Apparatus according to claim 1, in which each of said drive devices is operated to move the associated one of said clamp devices into its operative position in response to the sensing signal from the respective one of said position sensors disposed next to and forwardly of it.

5. Apparatus according to claim 3, in which each of said clamp devices includes an actuator mounted on said body for driving said pair of rolls, said actuator being operable to move said rolls away from each other immediately before said clamp device is moved out of its operative position, and also said actuator being operable to move said rolls toward each other immediately after said clamp device is moved to its operative position.

* * * * *